US005338103A

United States Patent [19]

Rassmann

[11] Patent Number: 5,338,103

[45] Date of Patent: Aug. 16, 1994

[54] CONTROL ARRANGEMENT FOR ADJUSTING THE POSITION OF A MINERAL WINNING MACHINE IN A MINERAL MINING INSTALLATION

[75] Inventor: Christoph Rassmann, Lunen, Fed. Rep. of Germany

[73] Assignee: Westfalia Becorit Industrietechnik GmbH, Fed. Rep. of Germany

[21] Appl. No.: 5,882

[22] Filed: Jan. 15, 1993

[30] Foreign Application Priority Data

Jan. 16, 1992 [DE] Fed. Rep. of Germany ..... 4200897

[51] Int. Cl.[5] ..... E21C 27/34; E21C 35/12

[52] U.S. Cl. ..... 299/32; 299/43

[58] Field of Search ..... 299/32, 34, 43

[56] References Cited

U.S. PATENT DOCUMENTS 4,462,637 7/1984 Rafael et al. ..... 299/43 X 4,571,004 2/1986 Braun et al. ..... 299/43 X

FOREIGN PATENT DOCUMENTS 1950916 9/1971 Fed. Rep. of Germany ..... 299/43

3111460 10/1982 Fed. Rep. of Germany .

1384543 2/1975 United Kingdom ..... 299/43

*Primary Examiner*—David J. Bagnell

*Attorney, Agent, or Firm*—Samuels, Gauthier & Stevens

[57] ABSTRACT

A mineral mining installation has a plough guided for movement along a scraper-chain conveyor. Roof supports are connected to the conveyor with the aid of shifting mechanisms which employ boom-type guide linkages designed to co-operate with a compact controller to adjust the tilt of the conveyor and the cutting horizon of the plough. The controller employs a plate-like guide block guided for up and down motion at the goaf side of the conveyor. An hydraulic piston and cylinder unit is disposed alongside the goal side of the conveyor and pivots a cranked lever to raise or lower the guide block. The guide block is coupled to a head-piece of an associated one of the boom linkages so that the motion of the guide block is transferred to the head-piece.

18 Claims, 2 Drawing Sheets

CONTROL ARRANGEMENT FOR ADJUSTING THE POSITION OF A MINERAL WINNING MACHINE IN A MINERAL MINING INSTALLATION

FIELD OF THE INVENTION

The present invention relates in general to mineral mining installation and more particularly to control means and control arrangements for adjusting the operating position of a winning machine, such as a plough, guided along a face conveyor.

BACKGROUND TO THE INVENTION

A control arrangement is known from U.S. Pat. No. 3,915,500 which utilizes a series of boom-type guide linkages extending between roof supports and a longwall face conveyor. The guide linkages have headpieces which are pivotably coupled to brackets on the goaf or stowage side of the conveyor and the operating position of a plough guided along the conveyor is controlled with the aid of upstanding hydraulic piston and cylinder units acting on the headpieces. Each headpiece is connected to a pair of resilient rods or bars constituting the associated guide linkage. The guide linkages are mounted on the roof supports for longitudinal motion and for swinging in a plane perpendicular to the mineral face. Thus these linkages serve additionally to guide the roof supports when these are shifted up towards the mineral face as well as to transmit the forces which arise during shifting of the conveyor and the roof supports.

In another known control arrangement, also utilizing the known boom-type guide linkages, as described in U.S. Pat. No. 4,462,637 an articulated toggle lever system is connected between the headpiece of each guide linkage and the conveyor and a piston and cylinder unit serves to operate the lever system. In this case the hydraulic units extend parallel to the conveyor and more or less horizontally.

A further control arrangment described in DE-3,111,460 has piston and cylinders units also disposed in a horizontal disposition parallel to the conveyor each serving to transmit the necessary control forces to a pivotable lever mounted with a ball-and-socket joint to the headpiece of the associated guide linkage. The lever is constructed to move along an arcuate path with the aid of a pin sliding in a track. The forces which are to be transmitted are relatively high and this necessitates a particularly heavy and strong construction and relatively large dimensions.

An object of the invention is to provide an improved control means and arrangement for boom-type guide linkages which is particularly compact.

SUMMARY OF THE INVENTION

A control arrangement in accordance with the invention utilizes a guide piece of modest size which cooperates with a headpiece on an end of a boom-type guide linkage coupled to a roof support and disposed on a goaf side of a conveyor remote from a mineral face side. The guide piece is slidably or rollably guided for up and down linear motion in the guide or track and is displaced with the aid of a lever operated by a hydraulic piston and cylinder unit or by some other mechanism. The necessary force transmitting connection between the guide piece and the headpiece on the associated guide linkage can take a variety of forms. Primarily the guide piece and the headpiece can lie in face to face contact. The contact faces may be serrated or toothed or otherwise shaped to inter-engage. In one embodiment described hereinafter one of the components i.e. either the headpiece or the guide piece has one or more convex faces while the other component i.e. the block or the headpiece has a similar shaped concave face or faces such that the respective faces interact in the manner of a ball and socket joint. The guide piece can take the form of a narrow plate or strip with a width considerably smaller than its length. The face of the guide piece remote from the headpiece can be plane and in contact with a surface of a component, such as a cover, fitted to the conveyor. The guide or track for controlling the motion of the guide piece can take the form of a pair of parallel strips defining a pocket for the guide piece. To displace the guide piece, preference is given to the use of a cranked lever pivotably mounted to the fitted component, e.g. the cover, and having a free end seated in a bearing recess in the guide piece. The other end of the lever is then coupled with a pivot joint to an hydraulic piston and cylinder unit disposed parallel to the conveyor. The lever can then swing in an upstanding plane parallel to the mineral face and along which the guide piece also moves.

A connector or coupling may be used to connect the guide piece and the headpiece in a detachable manner. This connector may take the form of a half-ring or U-shaped member which fits around the headpiece.

A control arrangement constructed in accordance with the invention may be used in an installation with a winning machine disposed on or over the conveyor. However the control arrangement is usable with advantage particularly in the case of a plough which runs back and forth alongside the mineral face side of the conveyor and more particularly with a sword plate type plough which has a sword plate extending beneath the conveyor and connected to a chain running in guide passages at the goaf side of the conveyor remote from the mineral side face.

The control means for the guide linkage in accordance with the invention can be of narrow compact form and thus its mounting to the constricted goaf side of the conveyor is not problematic. Indeed it is conventional with a sword-plate plough to have covers on the goal side wall of the conveyor to close off the chain guide passages and to construct these covers from components rigidly fixed to the conveyor with spacers and other components detachably secured with bolts or screws to permit access to the chain guide passages. The guide piece of the control means can in this case be mounted on the fixed cover components with the unit used to displace the guide piece disposed at the level of the uppermost chain guide passage and at the goal side of this passage. The associated guide linkage itself can be of known design forming part of the shifting mechanism of one of the roof supports and the headpiece can be mounted at the conveyor-facing end of a flat plate or resilient bar or beam or a walk-on platform of the linkage.

The invention may be understood more readily and various other aspects and features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
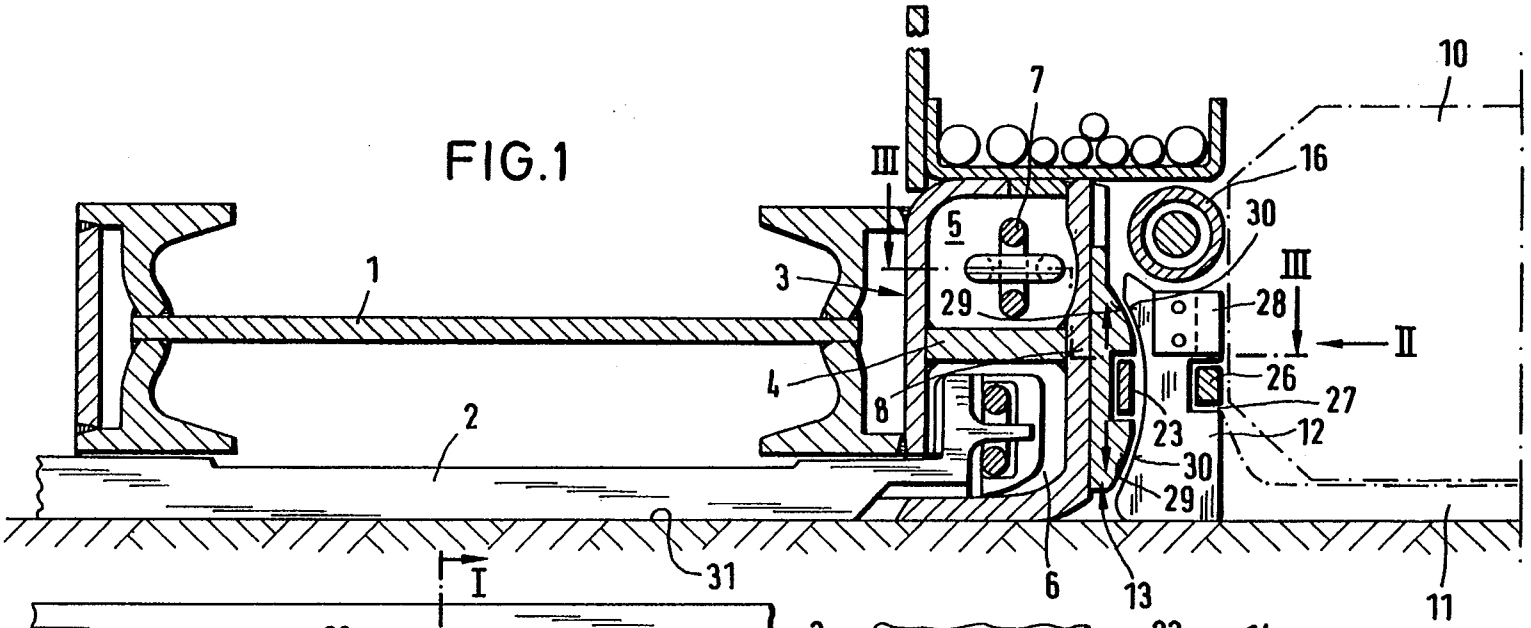
FIG. 1 is a sectional view looking along a mine working showing a mineral mining installation and a control arrangement constructed in accordance with the invention.

To assist in the understanding of the embodiment of the invention depicted in the accompanying drawings reference can be made to the published documents mentioned hereinbefore. The accompanying drawings depict a mineral mining installation which has a scraper-chain conveyor 1 composed of a series of channel sections or pans joined end-to-end as is known. The conveyor 1 is displaceable in the direction of a mineral face (not shown) at the left-hand side of FIGS. 1, 4, 5 and 6 to follow up the mineral winning process. Mineral is stripped from the mineral face, e.g. coal, face with the aid of a plough likewise not shown in the drawings. The plough is of the type known as a sword-plate plough which has a sword plate designated 2 extending below the conveyor 1. On the goaf side of the conveyor 1 remote from the mineral face there is a guide and propulsion structure 3 for the plough which is also of known construction. The structure 3 has upper and lower chain passages, 5, 6 through which run a drive chain 7 for propelling the plough back and forth along the conveyor 1. The passages 5, 6 are separated by spacers 4. The sword plate 2 engages in the lower passage 6 and is coupled to the lower drive run of the chain 7.

Figure 4:
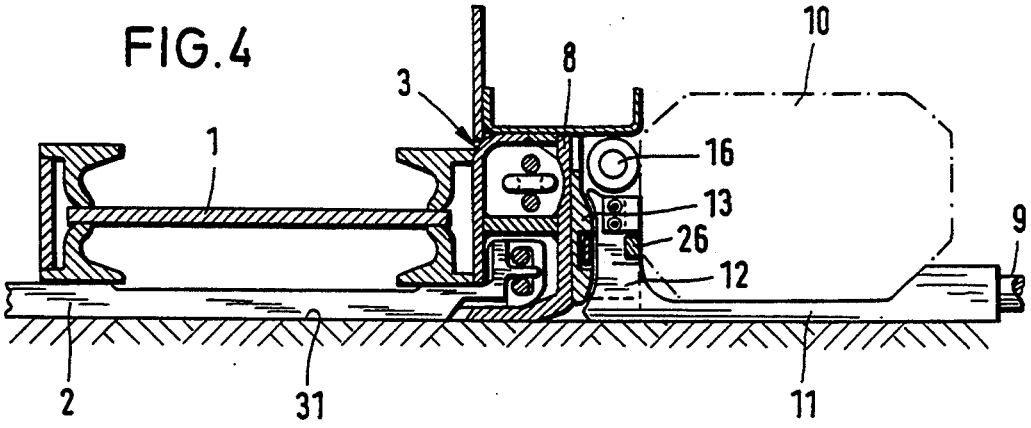
FIGS. 4, 5 and 6 are views corresponding to FIG. 1 showing the conveyor and the control arrangment in different operating positions.
Figure 5:
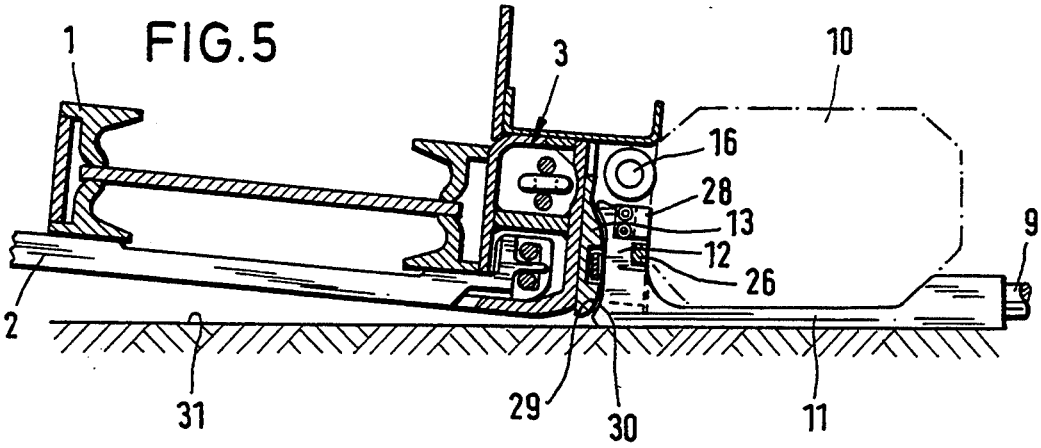
Figure 6:
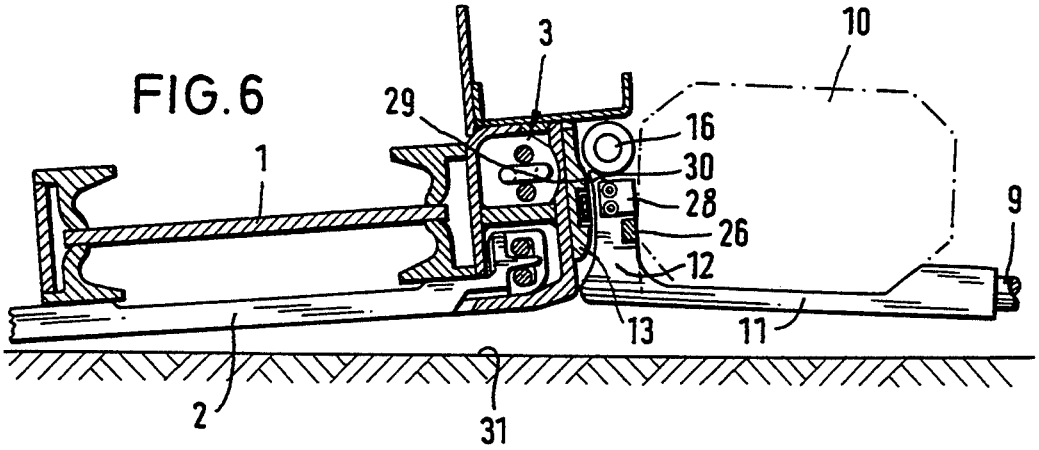

The structure 3 also employs covers which close the passages 5, 6 from the goal side of the working. These covers comprise components 8 fixed to the spacers 4 by welding and further components detachably secured with screws or bolts to the channel sections of the conveyor 1. The structure 3 is associated with a boom type control arrangement usable to control the cutting horizon of the plough. This control arrangement has boom or jib like guide linkages 9 with resilient bars or beams and each of which is formed as a flat platform or rail 11 at least over a region which bridges the goal access zone 10 of the working and carries an upwardly projecting rigid headpiece 12. Each linkage 9, 11 constitutes part of the walking or shifting mechanism (not shown) which enables roof supports and the conveyor 1 to be displaced in alternate walking steps towards the mineral face. Each linkage 9, 11 is guided for displacement in the shifting direction of the roof supports as well as to pivot in a plane at right-angles to the mineral face. The linkages 9, 11 thus performs a boom or jib control function as well as guiding the supports and transmitting the shifting forces so that the conveyor 1 and the plough guided on it is supported and controlled in the known manner, as for example described in U.S. Pat. No. 3,915,500, and as represented in FIGS. 4 to 6.

Figure 2:
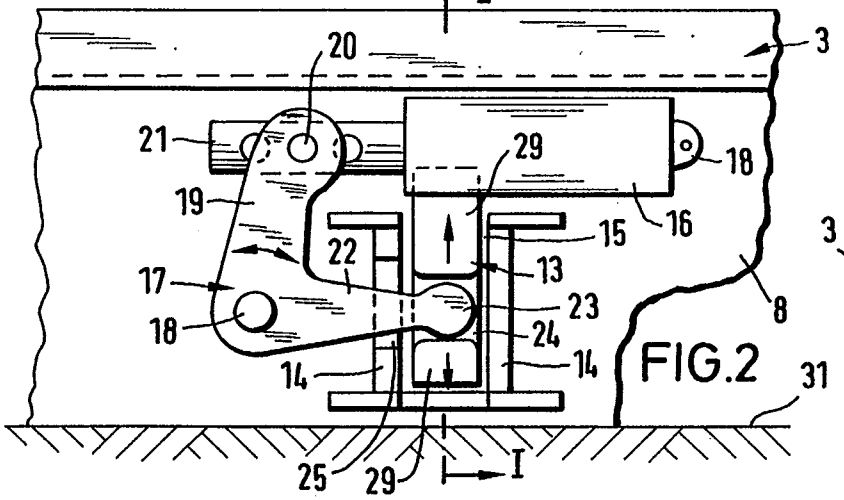
FIG. 2 is a side view taken in the direction of arrow II in FIG. 1 with parts of the control arrangment omitted for the sake of clarity.
Figure 3:
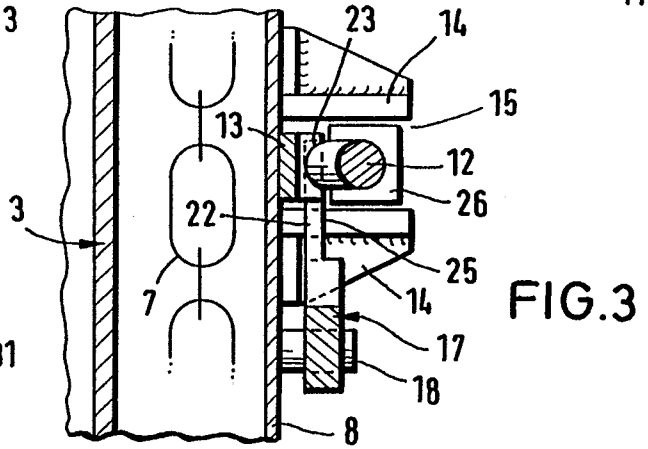
FIG. 3 is a simplified sectional plan view of part of the control arrangment taken on the line III—III of FIG. 1.

As represented by the arrows in FIG. 2 associated with each guide linkage 9, 11 there is a slidable guide member or piece 13 which is mounted on a fixed cover component 8 so it can be raised or lowered. The member 13 is a narrow plate or strip with a width smaller than its length, i.e. height. A plane rear face of the member 13 is slidably engaged on a plane outer support face of the cover component 8 which is rigidly mounted to the associated conveyor channel section.

The member 13 is further guided between two upwardly extending strips 14 fixed to the outside of the associated cover component 8. The strips 4 provide a guide pocket 15 which retains the member 13 and the upwardly projecting headpiece 12 fixed to the associated guide linkage 9. The guide member 13 serves to adjust the conveyor inclination with the aid of an hydraulic piston and cylinder unit 16. The unit 16 is mounted in a substantially horizontal position above the headpiece 12 and parallel to the conveyor 1. A connection member in the form of an angled lever 17 serves to connect the unit 16 to the guide member 13. The unit 16 has its cylinder connected with a pivot joint 18 to the cover component 8 at the height of the upper chain guide passage 5. The lever 17 is mounted on the cover component 8 in the plane of the narrow guide member 13 for pivoting about a pivot joint 18 normal to the mineral face and alongside the guide pocket 15. One arm 19 of the lever 17 is connected with a pivot joint 20 to a piston rod 21 of the unit 16. The other arm 22 of the lever 17 has a domed or curved free end 23 which fits in a bearing recess 24 in the guide member 13. The recess 24 is open towards the headpiece 12 and to the sides of the guide member 13. The strip 14 adjacent the lever 17 has an aperture 25 which receives the arm 22 of the lever 17. It can be appreciated that when the unit 16 is subjected to hydraulic pressure to extend or retract, the guide member 13 will be displaced by the lever 17 upwardly or downwardly in the guide pocket 15.

The associated guide linkage 9, 11 has its upwardly projecting headpiece 12 mounted for limited movement in a connection which is thrust and tension resistant, with the guide member 13 on the cover component 8. A coupling 26 fits around the rear portion of the headpiece 12 to retain the headpiece 12 against the displacable guide member 13. The coupling 26 can be U-shaped or a half-ring which fits around the headpiece 12 and the headpiece 12 then has a recess 27 which accommodates the coupling 26. The coupling 26 can be secured to the strips 14 by welding or preferably by a detachable fixing means. Thus, the coupling 26 is locked in the recess 27 with the aid of a locking or closure member 28 which is screwed or bolted on. When the locking member 28 is removed the headpiece 12 can be inserted from below into the coupling 26 and between the strips 14 and in engagement with guide member 13. When the locking member 28 is fitted the headpiece 12 is fixed in its close relationship to the guide member 13.

The force transmitting connection between the guide member 13 and the headpiece 12 and hence between the associated guide linkage 9, 11 and the conveyor 1 and the plough is completed by providing inter-engaging surfaces of these components. FIG. 1 shows in particular how the surface of the guide member 13 nearest the headpiece 12 is substantially curved in a convex manner while the headpiece 12 has a depression on the surface facing the member 13 thereby providing a ball-and-socket type joint. The member 13 has above and below the bearing recess 24 an inclined or slightly convex face 29 while the headpiece 12 is provided with matching surface regions 30.

FIG. 4 shows the installation with the conveyor 1 in a normal operating position whereat the floor cutters of the plough are working at the level of the floor 31 and the conveyor 1 is more or less parallel to the floor 31.

When hydraulic pressure fluid is applied to the unit 16 to cause the latter to retract, the lever 17 displaces the member 13 in the direction of the floor 31. The surfaces 29, 30 of the headpiece 12 and the member 13 guide one another and a tilting movement is imposed on the conveyor 1 so that the conveyor 1 pivots about the connection and the coupling 26 in relation to the linkage 9, 11 to adopt the working position represented in FIG. 5 where it is raised from the floor 31 at the working face side. This causes the plough to climb. When hydraulic pressure fluid is applied to the unit 16 to cause the latter to extend the lever 17 displaces the member 13 away from the floor 31. Now the surfaces 29, 30 of the headpiece 12 and the member 13 guide one another and a tilting movement is imposed on the conveyor 1 so that the conveyor 1 adopts the working position represented in FIG. 6 where it is raised from the floor 31 at the goaf side. This cause the plough to dip. It is evident that in the working position represented in FIG. 6 a pivotal movement is also imposed in the guide linkage 9, 11, so that the latter swings upwardly.

The control arrangement as described is particularly compact of low and narrow construction but otherwise operates essentially as in the manner known in prior art control arrangements as to the end result.

I claim:

1. In or for a mineral mining installation comprising a conveyor, a winning machine guided for movement along the conveyor and roof supports connected to the conveyor with a boom-type guide linkages; an improved control arrangement for adjusting the operating position of the machine, said control arrangement at least including a guide member, means connected to the conveyor for guiding the guide member for raising and lowering motion, means for displacing the guide member relative to the guide means comprising an hydraulic piston and cylinder unit and a pivotally mounted cranked lever connected between the unit and the guide member and means coupling the guide member to a headpiece of one of the guide linkages so that displacement of the guide member is transmitted to the headpiece in a manner to cause the conveyor to adopt various angular positions.

2. A control arrangment according to claim 1 wherein the coupling means is at least partly created by inter-engaging surfaces of the guide member and the headpiece.

3. A control arrangement according to claim 2 wherein the inter-engaging surfaces are curvilinear.

4. A control arrangment according to claim 3, wherein the guide member has at least one convex surface and the headpiece at least one concave surface and these surfaces inter-engage in the manner of a ball-and-socket joint.

5. A control arrangement according to claim 1 wherein the guide member is a narrow plate with a width smaller than its length.

6. A control arrangement according to claim 5, wherein the guide member is in face-to-face contact with a component fixed to the conveyor.

7. A control arrangement according to claim 6, wherein the component fixed to the conveyor is a cover which extends over upper and lower chain guide passages through which runs a drive chain for propelling the machine along the conveyor.

8. A control arrangement according to claim 7, wherein the means for displacing the guide member comprises an hydraulic piston and cylinder unit and a pivotably mounted cranked lever connected between the unit and the guide member and wherein the hydraulic unit is disposed in a substantially horizontal position alongside the conveyor and generally at the level of the upper guide passage but externally of this passage.

9. A control arrangment according to claim 8, wherein the boom linkages include flat rails or walk-on platforms adjacent the headpiece.

10. A control arrangement according to claim 1 wherein the guide means constrains the guide member to displace by sliding or rolling motion.

11. A control arrangment according to claim 1, wherein the coupling means includes a coupling member of half-ring or U-shaped configuration partly surrounding the headpiece.

12. A control arrangement according to claim 11, wherein the headpiece has a recess which accommodates the coupling.

13. A control arrangement according to claim 12 and further comprising releasable locking means for securing the coupling.

14. A control arrangment according to claim 12, wherein the guide means is composed of a pair of parallel strips defining a pocket receiving the guide member and the coupling is detachably fitted to the strips.

15. A control arrangement according to claim 1, wherein the cranked lever swings in a substantially upstanding plane.

16. A control arrangement according to claim 1, wherein the guide member has a bearing recess for receiving one end of the cranked lever.

17. A control arrrangement according to claim 16, wherein the guide means is composed of a pair of parallel strips defining a pocket receiving the guide member and an aperture is provided in one of the strips through which one end of the cranked lever extends.

18. A control arrangement according to claim 1, wherein said boom linkages form part of shifting mechanisms operably disposed between the roof supports and the conveyor.

* * * * *